United States Patent [19]

Suzuki

[11] 3,959,902

[45] June 1, 1976

[54] DISPLAY APPARATUS

[75] Inventor: Kooji Suzuki, Tokyo, Japan

[73] Assignee: Dai Nippon Insatsu Kabushiki Kaisha, Tokyo, Japan

[22] Filed: July 19, 1974

[21] Appl. No.: 490,194

[30] Foreign Application Priority Data

July 30, 1973 Japan ..... 48-84864
Oct. 24, 1973 Japan ..... 48-118983

[52] U.S. Cl. ..... 40/28 R; 40/37; 40/28 C

[51] Int. Cl.[2] ..... G09F 11/00

[58] Field of Search ..... 40/28 R, 28 C, 37, 39, 40/40

[56] References Cited

UNITED STATES PATENTS

| | | | |
|---|---|---|---|
| 3,374,565 | 3/1968 | Woolfolk | 40/28 C |
| 3,482,344 | 12/1969 | Holloman | 40/37 |
| 3,611,598 | 10/1971 | O'Keefe | 40/37 |
| 3,745,563 | 7/1973 | Jones | 40/28 C |

*Primary Examiner*—Edgar S. Burr
*Assistant Examiner*—A. Heinz
*Attorney, Agent, or Firm*—Spensley, Horn & Lubitz

[57] ABSTRACT

A number of elementary units each including an elementary plate member are arrayed in rows and columns to provide a screen, with each elementary plate member pivotally supported so as to be independently reversible as to its front and rear faces to be exhibited to the viewer. Both faces of each elementary plate member are imbued with different colors clearly distinguishable from each other. Pneumatic actuating means comprising air nozzles or slide valves for producing controlled currents of air under pressure are arranged behind the array of elementary plate members in a manner such that the elementary plate members are selectively reversed as to their front and rear faces, in the order of successive rows or columns, for the display of any desired graphic or alphanumeric pattern. The elementary unit itself can be used as a display device if the front and rear faces of the elementary plate bear necessary letters or patterns thereon.

13 Claims, 13 Drawing Figures

DISPLAY APPARATUS

BACKGROUND OF THE INVENTION

This invention relates to apparatus for display of graphic and alphanumeric patterns for publicity, amusement, information, or like purposes. More specifically, the invention deals with such display apparatus having a reversible display surface which is actuated by air pressure, or having a screen composed of an array of identical elementary plate members which are independently actuated by air pressure to exhibit desired patterns.

There have been known public display systems comprising a number of electric lamps which are arranged in neat rows and columns and which are selectively turned on or off for two-dimensional representation of graphic and alphanumeric matter. According to this known method of public display, however, the electric lamps in use must be almost constantly replaced as their service life is relatively short. Furthermore, since hundreds, thousands or an even greater number of lamps are required to provide a single display, a large amount of electric power is consumed in operation, and complex and bulky equipment is necessary for on-off control of the lamps. It is also a serious disadvantage of the prior art display systems that they are practically unusable at daytime or at least in broad daylight.

SUMMARY OF THE INVENTION

In view of the above stated drawbacks of the prior art display apparatus, it is an object of this invention to provide a display apparatus comprising an elementary plate member which can be reversed by relatively low air pressure for representation of letters, patterns and the like, so that the apparatus requires little operating costs and little maintenance care.

Another object of the invention is to provide a display apparatus of the character described which can be put to satisfactory use both at daytime and at nighttime.

Still another object of the invention is to provide a display apparatus of the character described which can be operated automatically by a control which may be far simpler and less expensive in construction than that of, for instance, the prior art apparatus utilizing electric lamps.

A further object of the invention is to provide a display apparatus wherein a number of the elementary plate members are combined to form an array thereof which forms a display screen and affords the provision of various graphic and alphanumeric patterns by independently actuating the elementary plate members.

With these objects in view and the other objects hereinafter set forth, this invention provides a display apparatus including at least one elementary plate member both faces of which bear letters or patterns, or are painted or otherwise imbued with different colors clearly distinguishable from each other and which are each supported in a manner pivotable about a pivot axis so as to be reversible with respect to their faces to exhibited to the viewer. The face reversal of the elementary plate member is accomplished by pneumatic actuating means arranged behind the elementary plate member, which means selectively delivers a forced current of air against one of the opposite portions, with respect to the pivot axis, of the plate member to cause its pivotal motion as required.

Characteristically, the display apparatus according to the invention, which is composed by combining a number of the elementary plate members, does not exhibit a desired pattern all at once, but through a gradual process row by row, or column by column, of the elementary plate members. Such gradual process of display is believed to have a peculiar appeal to the modern man, imparting a sense of familiarity to him in the highly mechanized world of today, and this is one of the objectives for which the display apparatus of this invention was designed. The faces of the elementary plate members may be coated with fluorescent paints for advantageous use at nighttime.

The features which are believed to be novel and characteristic of this invention are set forth with particularity is the appended claims. The invention itself, however, both as to its construction and mode of operation, together with the further objects and advantages thereof, will be best understood from the following description of specific embodiments of the invention taken in connection with the accompanying drawings wherein like reference characters designate like parts throughout the several views.

DETAILED DESCRIPTION

Figure 1:
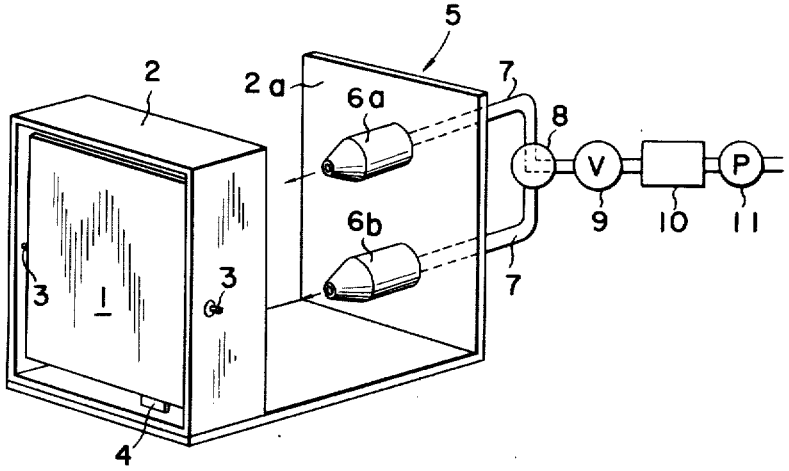
FIG. 1 is a combined perspective and schematic view, showing an elementary unit comprising an elementary plate member and its pneumatic actuating means, for an explanation of the operating principles of the display apparatus according to the invention.
Figure 2:
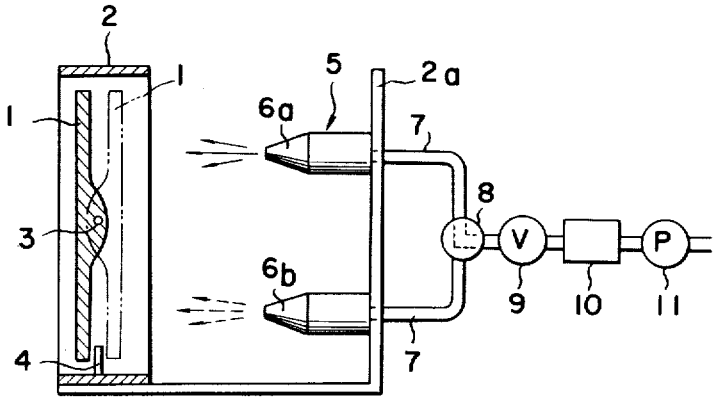
FIG. 2 is a side elevational view, partly in section, of the elementary unit shown in FIG. 1.

FIGS. 1 and 2 illustrate an elementary unit for use in the display apparatus according to this invention, including an elementary plate member 1 and pneumatic actuating means for controllably reversing the elementary plate member with respect to its front and rear races. The illustrated elementary plate member 1 is generally flat and rectangular in shape and has its opposite faces painted or otherwise imbued with different colors clearly distinguishable from each other, such as, for example, black and orange. The two faces of the plate member 1 may also bear suitable letters or patterns. The elementary plate member 1 is supported within a rectangular skeletal frame 2 so as to be pivotable about a pair of aligned pins 3. Desirably, these aligned pins 3 should be located off the center of gravity or the centroid of the elementary plate member 1 with respect to its top-to-bottom dimension, so that the plate member takes the solid line position whenever no external force is exerted thereto. A stop is affixed as at 4 to the frame 2 for arresting the pivotal motion of the elementary plate member 1 each time the same has completed substantially 180° rotation about the pins 3 in either direction.

Reference numeral 5 in FIGS. 1 and 2 generally designates the pneumatic actuating means associated with the elementary plate member 1. As will be clearly seen from the figures, the pneumatic actuating means 5 comprises a pair of vertically spaced apart nozzles 6*a* and 6*b* fixedly supported on a support plate 2*a* behind the elementary plate member 1 at an appropriate distance therefrom. These nozzles communicate via respective conduits 7 with a selector valve 8 which in turn communicates via a shutoff valve 9 with a tank 10 adapted to store air under pressure delivered from a pump 11.

In the operation of the arrangement shown in FIGS. 1 and 2, it will be assumed that the elementary plate member 1 has its front face (colored in black, or bearing suitable letters or patterns, for example) displayed to the viewer in the condition represented by the solid lines in FIG. 2. If now the selector valve 8 of the pneumatic actuating means 5 is operated to communicate the upper nozzle 6*a* with the compressed air tank 10 via the shutoff valve 9, which latter valve is assumed to be held open, then the stop 4 will retain the elementary plate member 1 in its illustrated position in spite of the air delivered under pressure from the upper nozzle 6*a* onto the upper portion of the elementary plate member. However, if the selector valve 8 is so operated as to communicate the lower nozzle 6*b* with the compressed air tank 10, then the elementary plate member 1 will pivot 180° about the aligned pins 3 and will assume the position represented by the dot-and-dash lines in FIG. 2, thereby displaying its rear face (colored in orange, or bearing suitable letters or patterns, for example) to the viewer.

On the other hand, if the upper nozzle 6*a* is caused by the selector valve 8 to communicate with the compressed air tank 10 while the elementary plate member 1 is in the position indicated by the dot-and-dash lines in FIG. 2, then the elementary plate member will turn 180° to the position indicated by the solid lines in the same figure, thereby displaying its front face to the viewer. The elementary plate member 1 will remain displaying its rear face if the lower nozzle 6*b* is caused to communicate with the compressed air tank 10.

It will be apparent from the foregoing description that regardless of whether the elementary plate member 1 is in the position represented by the solid lines or by the dot-and-dash lines in FIG. 2, the front face of the place member is displayed as a result of delivering air under pressure from the upper nozzle 6*a*, and its rear face as a result of delivering air under pressure from the lower nozzle 6*b*. This operating feature of the elementary plate member is essential for the operation of the display apparatus according to the invention.

Figure 3:
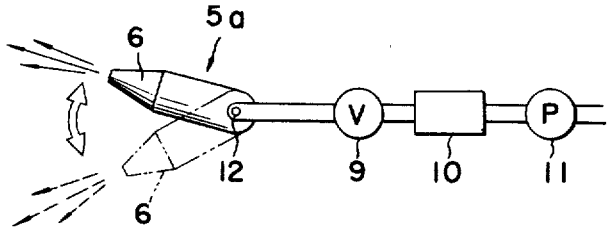
FIG. 3 is a schematic elevational view of another example of pneumatic actuating means for use in the display apparatus according to the invention.
Figure 4:
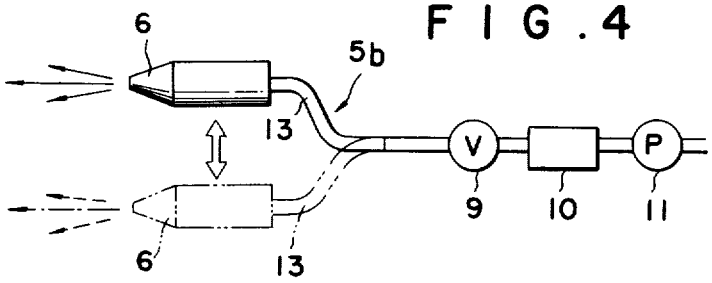
FIG. 4 is a similar view showing a further example of pneumatic actuating means.
Figure 5:
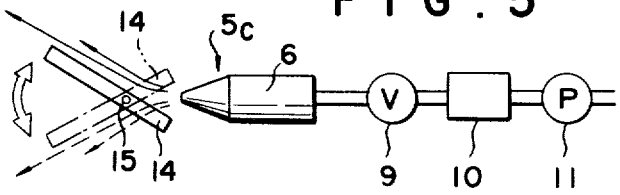
FIG. 5 is also a similar view showing a still further example of pneumatic actuating means.

It will also be apparent that the pneumatic actuating means 5 shown in FIGS. 1 and 2 is subject to various modifications within the broad teaching thereof, including but not limited to those achematically illustrated in FIGS. 3, 4, and 5. The modified actuating means 5*a* shown in FIG. 3 comprises but a single nozzle 6 which is pivotted at 12 to the tip of the conduit communicating the same to the air pump 11 via the shutoff valve 9 and the tank 10. In operation, the pivotally supported nozzle 6 may be swung up and down by suitable means, not shown, to cause the elementary plate member 1 to pivot about the aligned pins 3, as previously mentioned in connection with FIGS. 1 and 2.

FIG. 4 illustrates another modification of the pneumatic actuating means 5. The second modified actuating means 5*b* includes a hose or like flexible conduit 13 communicating the single nozzle 6 with the other conduit like that used in the FIG. 3. This nozzle 6 may be moved up and down by suitable means, not shown, relative to the elementary plate member 1 associated therewith, thereby causing the same to pivot about the aligned pins 3 by the stream of air delivered under pressure from the nozzle.

In a further modified example as shown in FIG. 5, the pneumatic actuating means 5*c* includes the single nozzle 6 fixedly supported at the tip of the conduit for communication with the air pump 11 via the shutoff valve 9 and tank 10. Characteristic of this third modified example of pneumatic actuating means is a flow regulator plate 14 pivoted at 15 forwardly of the nozzle 6. The flow regulator plate 14 is constrained to swinging motion about its pivot 15 through a predetermined angle, as indicated by the double headed arrow in the figure, in order to cause the elementary plate member 1 associated therewith to pivot in the manner previously set forth.

In all of the three possible modifications of the pneumatic actuating means 5 briefly described in the foregoing, the shutoff valve 9 may be of normally closed type and may be caused to open for a short time, as by means of a timer of well known construction, each time the elementary plate members 1 are required to be reversed as to their front and rear faces.

Figure 6:
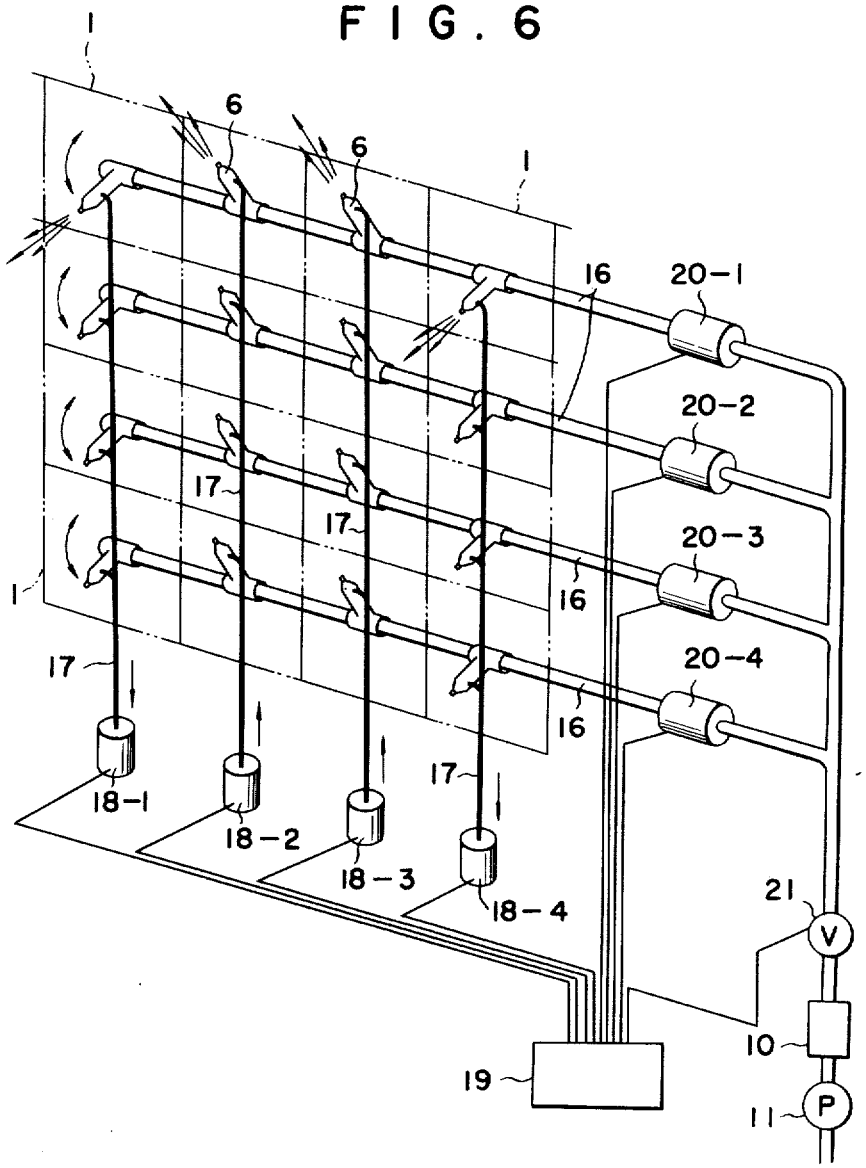
FIG. 6 is a schematic perspective view of the display apparatus according to this invention, in which a number of the elementary units are combined to form an array and in which there are incorporated a plurality of the pneumatic actuating means shown in FIG. 3.

FIG. 6 illustrates a preferred form of the display apparatus according to this invention, wherein a number of the elementary units are combined. The illustrated display apparatus comprises an array of elementary plate members 1, such as that previously described in conjunction with FIGS. 1 and 2, that are arranged in four rows and four columns purely by way of example, it being understood that any desired number of such elementary plate members can be similarly arranged in rows and columns to provide the display apparatus according to the invention. As will be apparent from FIG. 6, the pneumatic actuating means used in this display apparatus is of the type illustrated in FIG. 3. This, however, is also purely by way of example. It will be easy for those skilled in the art to incorporate other types of pneumatic actuating means, including those illustrated in FIGS. 1 and 2, FIG. 4 and FIG. 5, in the display apparatus of FIG. 6.

In the particular pneumatic actuating means shown in FIG. 6, air conduits 16 extend horizontally in parallel spaced relationship to each other on the back of the respective rows of elementary plate members 1. The air nozzles 6 are pivotally mounted at their basal ends on the conduits 16 so as to be in register with the respective elementary plate members 1. The respective columns of nozzles 6 are coupled via vertical links 17 to the plungers of solenoids 18-1 to 18-4 which are adapted to cause the nozzles to swing through the predetermined angle. The solenoids 18-1 to 18-4 are electrically connected to a control 19 of any known or suitable construction.

The horizontal air conduits 16 communicate via respective solenoid valves 20-1 to 20-4 with a common main shutoff valve 21 which may also be of solenoid operated type. The main shutoff valve 21 communicates with the tank 10 adapted to store compressed air from the pump 11. The solenoid valves 20-1 to 20-4 and the main shutoff valve 21 are also electrically connected to the control 19 as seen in FIG. 6. Normally, the main shutoff valve 21 may be held open so that the compressed air from the tank 10 fills the conduits up to the inlet ports of the respective solenoid valves 20-1 to 20-4.

In operation of the display apparatus shown in FIG. 6, the solenoids 18-1 to 18-4 is selectively actuated by the control 19 to determine the angular positions of the respective nozzles 6 in the uppermost row in accordance with a graphic or alphanumeric pattern to be displayed. In the condition represented in FIG. 6, the two nozzles located at the extreme left and right of the uppermost row are directed downwardly, whereas the two intermediate nozzles are directed upwardly. The solenoid valve 20-1 is then actuated to permit air under pressure to be delivered out of all the nozzles in the uppermost row for an appropriately short period of time. As a consequence, the elementary plate members corresponding to the downwardly directed nozzles will exhibit their orange-colored rear faces to the viewer, and those corresponding to the upwardly directed nozzles their black-colored front faces, as above stated in connection with FIGS. 1 and 2.

Figure 7:
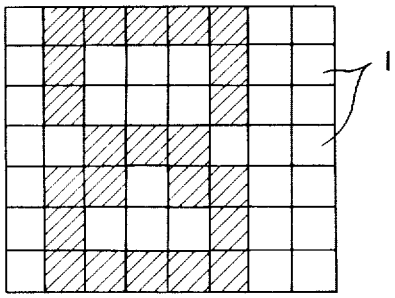
FIGS. 7 and 8 are front views schematically depicting patterns as displayed by the apparatus shown in FIG. 6.
Figure 8:
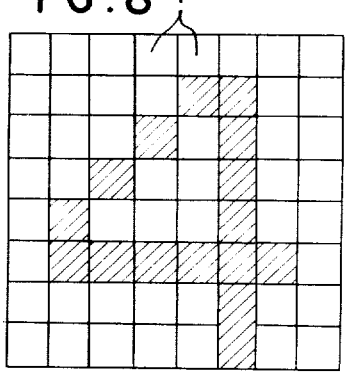

Succeedingly, the solenoids 18-1 through 18-4 are again selectively actuated to determine the angular positions of the respective nozzles in the second row in accordance with the pattern to be displayed. The solenoid valve 20-2 is then actuated to permit air under pressure to be delivered for a short period of time out of all the nozzles in the second row, thereby causing the corresponding elementary plate members to display their front or rear faces depending upon the angular positions of the respective nozzles. In this manner, the successive rows of elementary plate members are caused progressively to exhibit their front or rear faces, until at last the desired pattern is clearly displayed in orange against the solid black background, or in black against the orange background, as illustrated by way of example in FIGS. 7 and 8.

Notwithstanding the showing of FIG. 6, the conduits 16 may be arranged vertically on the back of the respective columns of elementary plate members 1, with the links 17 arranged horizontally to connect the respective rows of nozzles 6 to the corresponding solenoids 18-1 through 18-4. In this case, however, each link must be connected to the associated nozzles 6 such that the lengthwise displacement of the link causes vertical privoting movement of the nozzles. According to this alternative arrangement, the successive columns of elementary plate members will be caused progressively to exhibit their front or rear faces, either from the left to the right or vice versa. It will likewise be understood that in the arrangement shown in FIG. 6, the elementary plate members can be caused successively to exhibit their front or rear faces from the lowermost row toward the uppermost row or, if desired, in a randomly selected sequence of rows.

FIGS. 9 through 12, inclusive, are explanatory of the operating principles of a further preferred example of the elementary unit. As will be seen from FIGS. 9, 10, and 11 each elementary plate member 1 of the display apparatus is pirotally supported at 3 within the rectangular frame 2. The stop 4 is fixedly mounted on the inside surface of the frame 2 for purposes previously set forth in connection with FIG. 1 and 2. Also as above stated, the elementary plate member 1 has its opposite faces imbued with different colors clearly distinguishable from each other.

The pneumatic actuating means 5 comprises a pressure-tight enclosure 22 defining a plenum chamber 23 therein and fixedly mounted on the back of the frame 2. An electric fan or blower is mounted at 24 for constantly delivering air into the plenum chamber 23. This plenum chamber 23 communicates with the interior of the rectangular frame 2 via a pair of vertically spaced apart apertures **25*a* and 25*b* which are formed through a partition wall 25 and which are arranged opposite to the upper and lower portions, respectively, of the elementary plate member 1 with respect to its axis of rotation. In order to open or close these apertures 25*a* and 25*b* so as to cause the elementary plate member 1 to pivot about the aligned pins 3 in a desired direction, there are provided a rectangular plate member 26 mounted inside the frame 2 for horizontal sliding motion relative to the apertures 25*a* and 25*b*, and another rectangular plate member 27 mounted inside the enclosure 22 for vertical sliding motion relative to the apertures. The plate member 26 is referred to as the horizontal slide valve, and the other plate member 27 the vertical slide valve. These horizontal and vertical slide valves 26 and 27 are formed with ports the relative positions of which are clearly seen in the exploded perspective view of FIG. 12**.

The horizontal slide valve 26 has a pair of ports **28*a* and 28*b* formed therethrough, which ports are vertically spaced apart from each other a distance equal to the vertical spacing of the aforesaid apertures 25*a* and 25*b* and which are further horizontally spaced apart from each other a distance equal to the predetermined stroke of the horizontal slide valve. The vertical slide valve 27 also has a pair of ports 29*a* and 29*b* formed therethrough, which ports are vertically spaced apart from each other a distance equal to the vertical spacing of the apertures 25*a* and 25*b*. As will be seen from consideration of FIGS. 9 through 12, inclusive, the ports 28*a* and 28*b* of the horizontal slide valve 26 may be appropriately greater in size than the apertures 25*a* and 25*b*, and the ports 29*a* and 29*b* of the vertical slide valve 27** smaller in size than the apertures.

Figure 10:
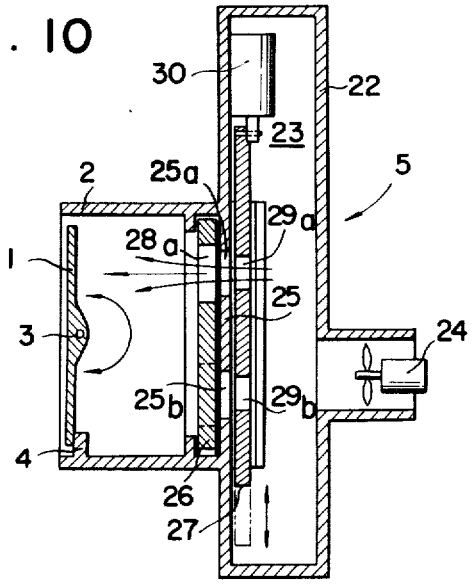
FIG. 10 is a sectional view taken along the plane of line X—X in FIG. 9.
Figure 11:
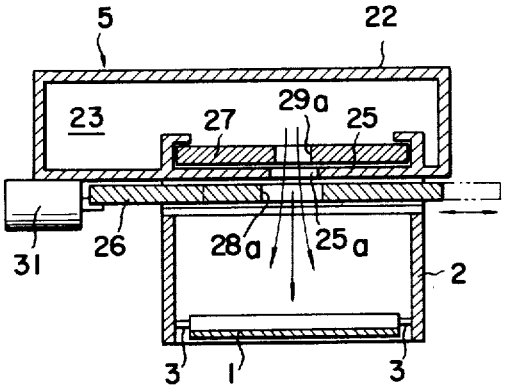
FIG. 11 is also a sectional view taken along the plane of line XI—XI in FIG. 9.

Thus, if the vertical slide valve 27 is moved to its prescribed lowermost position as by a solenoid 30, the apertures **25*a* and 25*b* of the enclosure 22 will become closed without regard to the position of the horizontal slide valve 26, so that the elementary plate member 1 will remain unreversed as to its front and rear faces. However, if the vertical slide valve 27 is shifted to its prescribed uppermost position, the pair of ports 29*a* and 29*b* of the vertical slide valve will become aligned with the apertures 25***a* and 25*b* respectively, as best represented in FIG. 10.

If now the horizontal slide valve 26 is shifted to its prescribed left hand position as by a solenoid 31, its upper port 28*a* will become aligned with the upper aperture 25*a* of the enclosure 22 and the upper port 29*a* of the vertical slide valve 27, as illustrated in FIGS. 9 to 12, inclusive. A stream of air is thus forced out of the plenum chamber 23 toward the upper portion of the elementary plate member 1, thereby causing the same to exhibit its front face to the viewer, as above described with reference to FIGS. 1 and 2. On the other hand, if the horizontal slide valve 26 is shifted to its prescribed right hand position, then its lower port 28*b* will become aligned with the lower aperture 25*b* of the enclosure 22 and the lower port 29*b* of the vertical slide valve 27, so that the elementary plate member 1 is caused to display its rear face to the viewer.

It will be understood from the foregoing description of FIGS. 9 to 12 that the vertical slide valve 27 function to open or close the apertures 25*a* and 25*b*, and the horizontal slide valve 26 to select either one of these apertures for causing air under pressure to be delivered against the upper or lower portion of the elementary plate member 1. If desired, the apertured partition wall 25 separating the plenum chamber 23 and the interior of the frame 2 may be dispensed with, the required functions of this pneumatic actuating means being accomplished solely by the horizontal and vertical slide valves 26 and 27.

Figure 13:
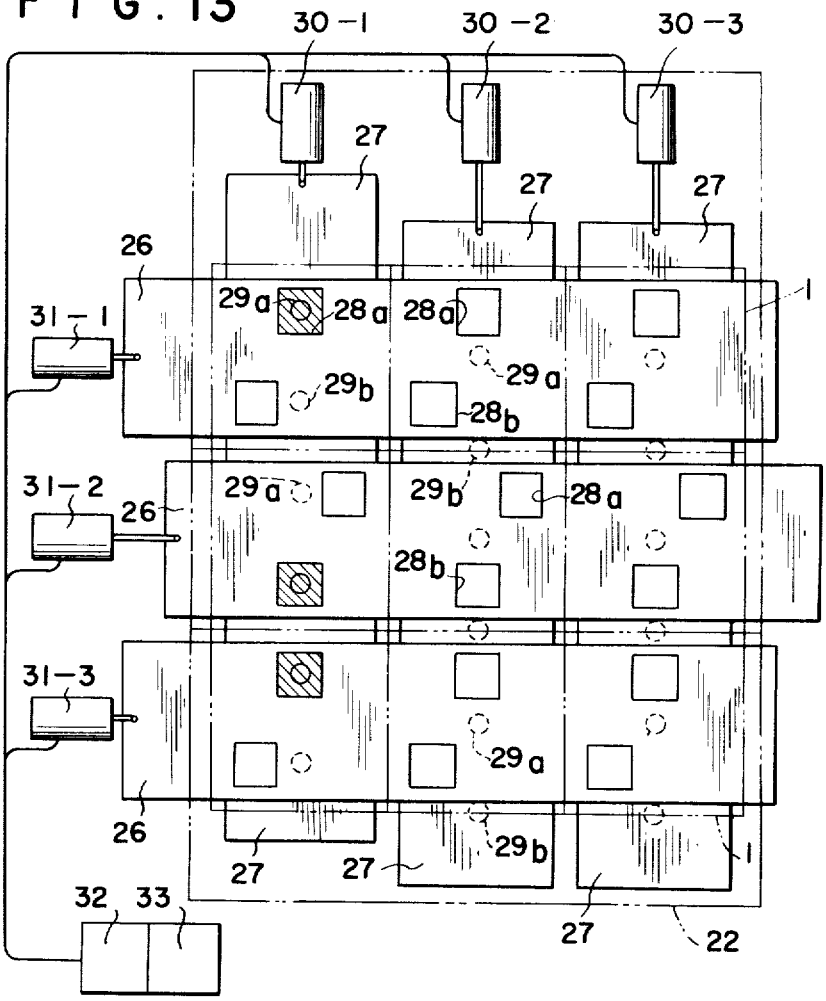
FIG. 13 is a schematic front elevational view of a further preferred embodiment of the invention in which there are incorporated a plurality of the pneumatic actuating means shown in FIGS. 9 through 12, inclusive.
Figure 9:
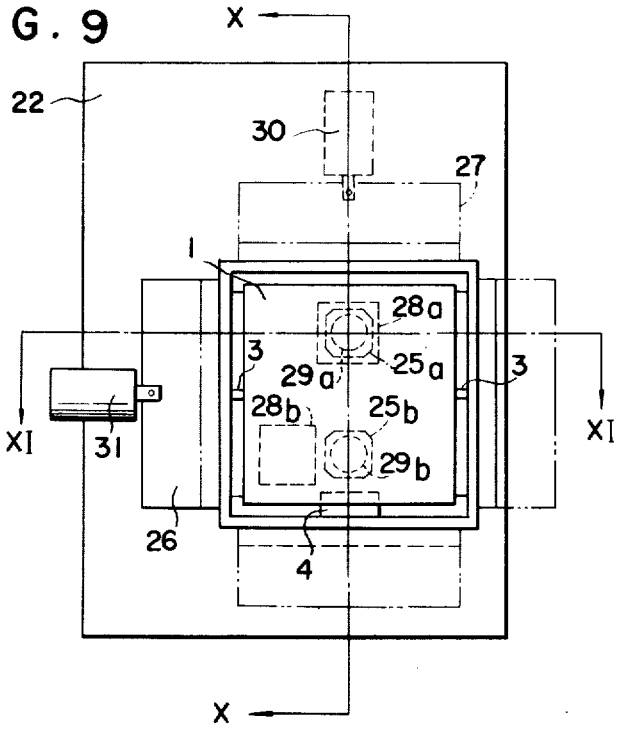
FIG. 9 is a front elevational view showing an elementary unit having the elementary plate member and a yet further example of pneumatic actuating means.

In the display apparatus schematically illustrated in FIG. 13, a number of the elementary units as shown in FIGS. 9 through 12, inclusive, are combined to form a display apparatus. The illustrated display apparatus comprises a plurality of elementary plate members 1, each constructed and pivotally supported in its own rectangular frame like that illustrated in FIGS. 9 to 11, inclusive, that are arrayed in three rows and three columns purely by way of example, it being grain understood that any desired number of such elementary plate members can be similarly arrayed in rows and columns to provide the display apparatus according to this invention.

A large, box-like enclosure 22 defining the plenum chamber therein is fixedly mounted on the back of the complete array of elementary plate members 1. The plenum chamber communicates with the interior of the rectangular frame enclosing each elementary plate member 1, as previously mentioned with reference to FIGS. 9 to 11, inclusive. A plurality of horizontal slide valves 26 are arranged on the back of the respective rows of elementary plate members 1 and are constrained to horizontal slide motion, as will be seen from the showings of FIGS. 10 and 11. The horizontal slide valves 26 are coupled at their left hand ends, as seen in FIG. 13, to the plungers of solenoids 31-1 to 31-3, respectively.

A plurality of vertical slide valves 27, which may be accommodated within the enclosure 22 as seen in FIG. 10, are arranged in register with the respective columns of elementary plate members 1 and are constrained to vertical slide motion. These vertical slide valves are coupled at their upper ends to the plungers of solenoids 30-1 to 30-3, respectively, which may also be mounted within the enclosure 22 as seen in FIG. 10. These solenoids 30-1 to 30-3, as well as the first mentioned solenoids 31-1 to 31-3, are electrically connected to a control 32 of prior art construction having an electric power supply 33.

Figure 12:
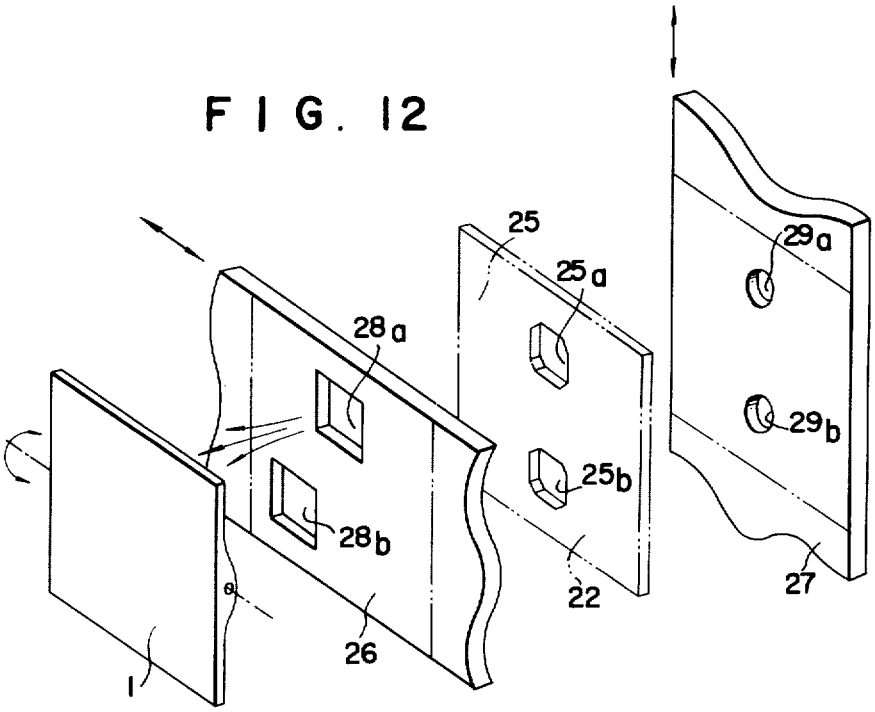
FIG. 12 is a fragmentary, exploded perspective view showing the relative positions of various ports and apertures in the apparatus shown in FIGS. 9 to 11.

As above stated with particular reference to FIG. 12, each of the horizontal slide valves 26 has pairs of vertically and horizontally spaced apart ports 28*a* and 28*b* therethrough for pneumatically actuating the respective elementary plate members 1 of each row. Similarly, each of the vertical slide valves 27 has pairs of vertically spaced apart ports 29*a* and 29*b* therethrough for pneumatically actuating the respective elementary plate members of each column in cooperation with the corresponding ports 28*a* and 28*b* of the horizontal slide valves 26.

Although not indicated in FIG. 13, the plenum chamber within the enclosure 22 may be communicated with the interiors of the enclosing frames of the respective elementary plate members 1 via the apertures as those labelled 25*a* and 25*b* in FIG. 12. Alternatively, those portions of the enclosure 22 facing the respective elementary plate members 1 may be completely cut open. It is further assumed that an electric fan, blower, or like means for producing a forced current of air is mounted on the back of the enclosure 22 for constantly delivering air under pressure into the plenum chamber.

In the operation of the display apparatus shown in FIG. 13, all of the vertical slide valves 27 should initially be held in their lowermost position to close the apertures or openings of the enclosure 22. The soelnoids 31-1 to 31-3 may then be selectively actuated by the control 32 to bring the upper or lower ports of the respective horizontal slide valves 26 into register with, say, the left hand column of elementary plate members 1 in accordance with a desired graphic or alphanumeric pattern to be displayed.

In the condition represented in FIG. 13, the upper port of the uppermost horizontal slide valve, the lower port of the intermediate horizontal slide valve, and the upper port of the lowermost horizontal slide valve are positioned in their operative positions in the left hand column of the display apparatus, as indicated by the hatchings in the figure. The solenoid 30-1 is then actuated to raise the left hand vertical slide valve to its uppermost position, thereby causing forced currents of air to be delivered against the backs of the left hand column of elementary plate members 1. The left hand vertical slide valve is caused to descend to its lowermost position immediately after the desired front or rear faces of all the elementary plate members in the left hand column have been properly exhibited to the viewer.

Succeedingly, the solenoids 31-1 to 31-3 are again selectively actuated to bring the upper or lower ports of the respective horizontal slide valves into register with the intermediate column of elementary plate members in accordance with the pattern to be displayed. The solenoid 30-2 is then actuated to raise the intermediate vertical slide valve to its uppermost position, so that currents of air under pressure are similarly delivered against the backs of the elementary plate members in the intermediate column. An identical procedure is repeated on the right hand column of elementary plate members. The desired graphic or alphanumeric pattern can thus be clearly displayed on the screen composed of the array of elementary plate members, as previously described and illustrated in FIGS. 7 and 8.

The display apparatus shown in FIG. 13 is advantageous in that it is simple and inexpensive in construction, requires no great space for installation of its pneumatic actuating means, and is operable with currents of air having a pressure only slightly higher than the atmospheric pressure. It is an additional advantage of this embodiment of the invention that no substantial noise is produced by its pneumatic actuating means.

What is claimed is:

1. A display device for representing graphic and alphanumeric matter comprising:

a. a framework having at least one elementary plate member, said elementary plate member having a rotational axis and being rotatably coupled to said framework such that when a force is applied to said plate member at a predetermined location adjacent said rotational axis, said plate member is caused to rotate in a first or second direction, each said plate member having first and second substantially flat faces;

b. stop means disposed on said framework for selectively stopping the rotation of said plate member when one of said faces of said plate members is visible to a viewer; and c. pneumatic actuating means located a predetermined distance from said elementary plate member for selectively delivering a forced current of air against said plate member such that said forced current of air causes said elementary plate to selectively rotate in said first or second direction thereby exposing said first face or said second face of said plate member, said pneumatic actuating means comprising:

i. means for delivering air under pressure to said pneumatic actuating means;

ii. a first slide valve located between said pneumatic actuating means and said plate member and movably disposed to interrupt said current of air and having at least first and second ports for directing said forced current of air to said plate member so as to strike said plate member adjacent said rotational axis, said first slide valve being movable between first and second positions; and iii. a second slide valve positioned so as to be between said pneumatic actuating means and said first slide valve, said second slide valve being movable between first and second positions, said first and second slide valves being disposed between said pneumatic actuating means and said plate member such that when said second valve is in said first position, said forced current of air is directed through said first port of said first slide valve thereby causing said plate member to rotate in said first direction, and when said second slide valve is in said second position, said forced current is directed through said second port of said first slide valve thereby causing said plate member to rotate in said second direction.

2. The display device according to claim 1 wherein said first and second slide valves are disposed in said pneumatic actuating means so as to be transverse to said forced current of air.

3. The display device according to claim 1 wherein a plurality of said device are coupled together into a predetermined configuration.

4. The display device according to claim 1 wherein said first and second slide valves and said means for delivering air are coupled to an enclosure defining a plenum chamber therein.

5. The display device according to claim 1 wherein said stop means stops said rotation of said plate member when said plate member substantially completes a 180° rotation in either of said first or second direction.

6. The display device according to claim 4 wherein said rotational axis of said plate member is located a predetermined distance from said first slide valve normal to said forced current of air and parallel to said plenum chamber.

7. The display apparatus as claimed in claim 1, wherein the elementary units are arranged to form an array comprising rows and columns of the units.

8. In a display apparatus for representation of graphic and alphanumeric matter comprising at least one elementary display unit, wherein each unit comprises a framework, an elementary plate member having an axis and being pivotally supported by said framework so as to be rotatable in two directions around said axis when a force is applied to said plate member at a predetermined location, said plate member having two opposed face sections, stop means on said framework for arresting the rotary motion of said elementary plate member about said axis upon completion of substantially 180° rotation in either of said two directions, and pneumatic actuating means disposed adjacent one of said face sections for selectively delivering a forced current of air against said plate member to cause the rotary motion thereof in either of said two directions;

the improvement wherein said pneumatic actuating means comprises air supply means having first and second air supply openings for delivering air against said elementary plate member, a slide valve disposed adjacent said air supply openings and movable transversely to said forced current of air between first and second operative positions and having a pair of spaced apart first and second ports therethrough, said first port coinciding with said first opening when said slide valve is in said first operative position and said second port coinciding with said second opening when said slide valve is in said second operative position, and valve means movable between first and second positions for concurrently opening and closing each of said air supply openings such that when said valve means is in said first position, said forced current is permitted to exit from said first port, and when said valve means is in said second position, said forced current of air is permitted to exit from said second port.

9. The display apparatus according to claim 8 wherein said valve means comprises a second slide valve disposed adjacent said air supply openings and parallel to said first slide valve, said second slide valve being slidably disposed in said apparatus between first and second positions.

10. The display apparatus according to claim 9 wherein said first slide valve has first and second spaced apart ports therethrough, and wherein said second slide valve has first spaced apart ports therethrough, whereby movement of either said first slide valve or said second slide valve causes one of said ports of said first slide valve to align with one of said ports of said second slide valve so as to permit said forced current of air to strike said plate member.

11. The display apparatus according to claim 8 wherein said air supply means comprises an enclosure arranged on one side of said elementary plate member, said air supply means defining a plenum chamber therein, said chamber having a wall through which said air supply openings are formed, and means for delivering air under pressure into said plenum chamber.

12. The display apparatus according to claim 8 wherein a plurality of said display devices are interconnected and arranged to form an array.

13. The display apparatus according to claim 8, wherein said slide valves are of planar form.

* * * * *